US006022677A

United States Patent [19]

Bourdelais et al.

[11] Patent Number: 6,022,677

[45] Date of Patent: Feb. 8, 2000

[54] IMAGING ELEMENT WITH BIAXIALLY ORIENTED BACKSIDE WITH IMPROVED SURFACE

[75] Inventors: Robert P. Bourdelais, Pittsford; Douglas N. Haydock, Webster; Thaddeus S. Gula, Rochester; Peter T. Aylward, Hilton; Pang-Chia Lu, Pittsford, all of N.Y.

[73] Assignee: Eastman Kodak Company, Rochester, N.Y.

[21] Appl. No.: 08/998,357

[22] Filed: Dec. 24, 1997

[51] Int. Cl.[7] ..... G03C 1/79; G03C 1/765; G03C 1/95

[52] U.S. Cl. ..... 430/496; 430/200; 430/201; 430/536; 430/538; 430/950; 347/106; 156/219; 156/279

[58] Field of Search ..... 430/536, 538, 430/950, 496, 527, 200, 201; 347/106; 156/219, 279

[56] References Cited

U.S. PATENT DOCUMENTS

| | | | |
|---|---|---|---|
| 4,187,113 | 2/1980 | Mathews et al. | 430/533 |
| 4,283,486 | 8/1981 | Aono et al. | 430/538 |
| 4,377,616 | 3/1983 | Ashcraft et al. | 428/213 |
| 4,610,924 | 9/1986 | Tamagawa et al. | 430/538 |
| 4,632,869 | 12/1986 | Park et al. | 428/315.5 |
| 4,678,742 | 7/1987 | Tamagawa et al. | 430/950 |
| 4,758,462 | 7/1988 | Park et al. | 428/213 |
| 4,870,001 | 9/1989 | Ashida | 430/538 |
| 4,912,333 | 3/1990 | Roberts et al. | 250/487.1 |
| 4,994,312 | 2/1991 | Maier et al. | 428/36.5 |
| 5,429,916 | 7/1995 | Ohshima | 430/538 |
| 5,466,519 | 11/1995 | Shirakura et al. | 430/538 |
| 5,476,708 | 12/1995 | Reed et al. | 428/211 |
| 5,514,460 | 5/1996 | Surman et al. | 428/304.4 |
| 5,516,563 | 5/1996 | Schumann et al. | 428/34.2 |
| 5,800,973 | 9/1998 | Anderson et al. | 430/950 |
| 5,874,205 | 2/1999 | Bourdelais et al. | 430/536 |
| 5,888,643 | 3/1999 | Aylward et al. | 430/536 |
| 5,888,683 | 3/1999 | Gula et al. | 430/536 |
| 5,902,720 | 5/1999 | Haydock et al. | 430/536 |

FOREIGN PATENT DOCUMENTS

| | | |
|---|---|---|
| 0 664 223 | 7/1995 | European Pat. Off. . |
| 0 803 377 A1 | 10/1997 | European Pat. Off. . |

*Primary Examiner*—Richard L. Schilling
*Attorney, Agent, or Firm*—Paul A. Leipold

[57] ABSTRACT

The invention relates to a imaging element comprising a layer of biaxially oriented sheet adhered to the bottom surface of a base wherein said biaxially oriented sheet adhered to the bottom surface has a surface roughness average of between about 0.30 to 2.00 $\mu$m.

21 Claims, No Drawings

IMAGING ELEMENT WITH BIAXIALLY ORIENTED BACKSIDE WITH IMPROVED SURFACE

FIELD OF THE INVENTION

This invention relates to imaging materials. In a preferred form it relates to base materials for photographic papers.

BACKGROUND OF THE INVENTION

It has been proposed in U.S. Pat. No. 5,244,861 to utilize biaxially oriented polypropylene laminated to cellulose photographic grade paper for use as a reflective receiver for thermal dye transfer imaging process. In this invention low density polyethylene is melt extrusion coated onto the backside of the reflective receiver to balance the reflective receiver for curl, provide waterproofing to the paper and provide the proper backside roughness for printer transport.

In the formation of photographic papers, where an emulsion layer containing gel is coated onto the base paper that has been extrusion coated with low density polyethylene, there is a need to provide a base paper with improved resistance to curl. When the relative humidity is greater than 50% or less than 20%, as is common in the storage of photographic images, the curl of photographic paper interferes with the viewing of images. A solution to the photographic curl problem has been proposed in U.S. application 08/864,228 filed May 23, 1997. In this invention, a mechanism to reduce curl in relative humidity greater than 50% or less than 20% is accomplished by applying a biaxially oriented polyolefin sheet to the backside of the paper base to balance the forces caused by the expansion and contraction of the emulsion layer in a relative humidity environment greater than 50% or less than 20%.

While the invention in U.S. application 08/864,228 filed May 23, 1997 does significantly improve the humidity curl of photographic paper, the typical surface roughness of the biaxially oriented sheets described in the invention that can be applied to the backside of the paper are smooth, with an roughness average or Ra less than 0.23 $\mu$m. As the photographic images are processed in photoprocessing equipment (photographic printers, photographic processors and photographic finishers), the photographic paper must be transported through many different types of equipment. In the formation of color paper it is known that the backside of the color paper is made sufficiently rough by casting polyethylene against a rough chilled roll. Photographic papers made in this manner are very efficiently transported though photoprocessing equipment. Photographic papers with backside roughness less than 0.30 $\mu$m cannot be efficiently transported in the photoprocessing equipment, as many transport problems will occur. Transport problems such as scratching, machine jams, and poor print stacking will begin to occur with backside roughness less than 0.30 $\mu$m. It would be desirable if a backside surface could be formed with the strength properties to control curl and a surface roughness greater than 0.30 $\mu$m to allow for efficient photoprocessing.

Photographic papers that are smooth on the backside will tend to stick together as the smooth backside of the print is in contact with the smooth image layer as is the case when photographic prints in the final image format are stacked for efficient storage. There remains a need for photographic papers that will not block or stick together as prints are stored.

In the final image format, it is common for consumers to write personal information on the backside of the images with pens, pencils, and other writing instruments. Photographic papers that are smooth on the backside are more difficult to write on. There is also a desire to print information from Advanced Photo System negatives onto prints made from these negatives. Therefore, there is a need for color prints to receive printing on their back There remains a need for photographic papers that are sufficiently rough so that writing or printing on the backside of the photographs can be easily accomplished.

During the manufacturing process for photographic papers, it is a requirement that silver halide emulsion coated paper be handled and transported in roll form. In roll form, the backside of the photographic paper is in contact with the silver halide image forming layer. If the roughness of the backside exceeds 2.54 $\mu$m, the image forming layer would begin to become embossed with the surface roughness pattern while in the roll form. Any customer perceived embossing of the image forming layer will significantly decrease the commercial value of the image forming layer. Furthermore, silver halide emulsions tend to be pressure sensitive. A sufficiently rough backside, in roll form, would begin to also destroy the commercial value of the image forming layer by developing the silver emulsion with pressure from the surface roughness of the backside. There remains a need for a photographic paper that has a backside roughness less than 2.54 $\mu$m so that photographic paper can be conveniently wound and stored in roll format.

In the formation of reflective receivers for digital imaging systems such as Ink Jet and Thermal Dye Transfer, there is a need to reduce the curl of the image. Lamination of a high strength biaxially oriented polyolefin sheet to the backside of the image does improve the curl over the common practice of extrusion coating a layer of polyolefin. Reflective receivers for digital imaging systems that have a smooth backside will cause transport problems in the various types of printers that are common in digital printing. Transport difficulties resulting from a smooth backside could cause unacceptable paper path jams, scratches on the image, and failure to pick the receiver from a stack. For ink jet and thermal dye transfer receivers it would be desirable if a backside surface could be formed with the strength properties to control curl and a surface roughness greater than 0.30 $\mu$m to allow for efficient photoprocessing.

PROBLEM TO BE SOLVED BY THE INVENTION

There remains a need for a imaging element that has a backside roughness greater than 0.30 $\mu$m and less than 2.00 $\mu$m that will allow for efficient photoprocessing, will not block or stick together as images are stored, and consumers can easily write or print information on the backside of an image.

SUMMARY OF THE INVENTION

An object of the invention is to provide improved imaging materials.

A further object is to provide a base for images that will have desired backside roughness.

Another object is to provide a imaging material that does not block and is easily writable.

These and other objects of the invention generally are accomplished by a providing an imaging element comprising a paper base, at least one photosensitive silver halide layer, a layer of biaxially oriented polymer sheet between said paper base and said silver halide layer, and a biaxially oriented polymer sheet on the opposite side of said paper base from said imaging layer wherein the exposed surface of the said biaxially oriented sheet has a roughness between about 0.30 μm and 2.00 μm.

ADVANTAGEOUS EFFECT OF THE INVENTION

The invention provides an improved base for the casting of photosensitive layers. It particularly provides an improved base for color photographic materials that have the required backside roughness for efficient transport though photoprocessing equipment.

DETAILED DESCRIPTION OF THE INVENTION

There are numerous advantages of the invention over prior practices in the art. The invention provides a photographic element that has much less tendency to curl when exposed to extremes of humidity. Further, the invention provides a photographic paper that has the required backside roughness to allow for efficient transport through photoprocessing equipment. Photographic papers that are smooth can lead to transport difficulties and jamming of the machines required for developing, transporting, and packaging of photographic paper.

Another advantage of the backside roughness of this invention is the reduction in tendency for photographic images in the final customer format to stick together. Images in the final customer format are commonly stored on top of each other. In that form, as the backside of the photographic images is in contact with the emulsion side, there is a tendency for the images to stick together especially with temperatures over 27° C. and relative humidity greater than 50%. This makes subsequent viewing of the stacked images difficult, as the consumer must separate the images before viewing.

A further advantage of this invention is a more effective surface for writing on the backside of images. The ability to write on the backside images using conventional writing instruments such as pens and pencils is a function of both surface roughness and ability of the surface to absorb inks. The invention also allows faster printing of Advanced Photo System information. This invention allows for increasing surface roughness and, thus, the ability for the consumer or printer to write necessary information on the backside of the image.

Another advantage of this invention is the ability to more efficiently create roughness on the backside of the images. Prior practices utilized expensive coatings that, when dry, increase the roughness of the backside. Prior practices also utilized the casting of the backside polyethylene against expensive rough chilled rolls to create the surface roughness required for effective writing on the backside of images. These and other advantages of the invention will be apparent from the detailed description below.

The terms as used herein, "top", "upper", "emulsion side", and "face" mean the side or toward the side of a photographic member bearing the imaging layers. The terms "bottom", "lower side", and "back" mean the side or toward the side of the photographic member opposite from the side bearing the photosensitive imaging layers or developed image.

Any suitable biaxially oriented polyolefin sheet may be used for the sheet on the topside of the laminated base of the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\frac{\text{Composite Sheet Density}}{\text{Polymer Density}} \times 100 = \%\text{ of Solid Density}$$

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 μm, preferably from 20 to 70 μm because below 20 μm, the microvoided sheets may not be thick enough to minimize any inherent non-planarity in the support and would be more difficult to manufacture. At thickness higher than 70 μm, little improvement in either surface smoothness or mechanical properties is seen, and so there is little justification for the further increase in cost for extra materials.

The biaxially oriented sheets of the invention preferably have a water vapor permeability that is less than $0.85\times10^{-5}$ g/mm$^2$/day/atm. This allows faster emulsion hardening, as the laminated support of this invention greatly slows the rate of water vapor transmission from the emulsion layers during coating of the emulsions on the support. The transmission rate is measured by ASTM F1249.

"Void" is used herein to mean devoid of added solid and liquid matter, although it is likely the "voids" contain gas. The void-initiating particles which remain in the finished packaging sheet core should be from 0.1 to 10 μm in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the topside toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a typical biaxially oriented, microvoided sheet of the invention is as follows:

| |
|---|
| Solid skin layer |
| Microvoided core layer |
| Solid skin layer |

The sheet on the side of the base paper opposite to the emulsion layers may be any suitable sheet having the surface roughness used in this invention. The sheet may or may not be microvoided It may have the same composition as the sheet on the topside of the paper backing material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425, the disclosure of which is incorporated by reference.

The preferred biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent non-planarity in the support and would be more difficult to manufacture. At thickness higher than 70 $\mu$m, little improvement in either surface smoothness or mechanical properties is seen, and so there is little justification for the further increase in cost for extra materials.

Suitable classes of thermoplastic polymers for the biaxially oriented sheet core and skin layers include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefm ionomers. Copolymers and/or mixtures of these polymers can be used.

Suitable polyolefins for the core and skin layers include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azeiaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with one or more layers of the same polymeric material, or it can be made with layers of different polymeric composition. For compatibility, an auxiliary layer can be used to promote adhesion of multiple layers.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The surface roughness of biaxially oriented film or Ra is a measure of relatively finely spaced surface irregularities such as those produced on the backside of photographic materials by the casting of polyethylene against a rough chilled roll. The surface roughness measurement is a measure of the maximum allowable roughness height expressed in units of micrometers and by use of the symbol Ra. For the irregular profile of the backside of photographic materials of this invention, the average peak to valley height, which is the average of the vertical distances between the elevation of the highest peak and that of the lowest valley, is used.

Biaxially oriented polyolefin sheets commonly used in the packaging industry are commonly melt extruded and then orientated in both directions (machine direction and cross direction) to give the sheet desired mechanical strength properties. The process of biaxially orientation generally creates a surface roughness of less than 0.23 μm. While the smooth surface has value in the packaging industry, use as a backside layer for photographic paper is limited. Laminated to the backside of the base paper, the biaxially oriented sheet must have a surface roughness greater than 0.30 μm to ensure efficient transport through the many types of photofinishing equipment that have been purchased and installed around the world. At surface roughness less that 0.30 μm, transport through the photofinishing equipment becomes less efficient. At surface roughness greater than 2.54 μm, the surface would become too rough causing transport problems in photofinishing equipment, and the rough backside surface would begin to emboss the silver halide emulsion as the material is wound in rolls.

The structure of a typical biaxially oriented sheet of this invention with the skin layer on the bottom of the photographic element is as follows:

| |
|---|
| Solid core containing one or more layers |
| Skin layer |

The surface roughness is accomplished by introducing addenda into the bottommost layer. The particle size of the addenda is preferably between 0.20 μm and 10 μm. At particles sizes less than 0.20 μm, the desired surface roughness can not be obtained. At particles sizes greater than 10 μm, the addenda begins to create unwanted surface voids during the biaxially orientation process that would be unacceptable in a photographic paper application and would begin to emboss the silver halide emulsion as the material is wound in rolls. The preferred addenda to be added to the bottommost skin layer, to create the desired backside roughness, comprises a material selected from the group consisting of titanium dioxide, silica, calcium carbonate, barium sulfate, kaolin, and mixtures thereof.

Addenda may also be added to the biaxially oriented backside sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

Another method of creating the desired roughness on the bottommost skin layer of a biaxially oriented sheet is the use of incompatible block copolymers. Block copolymers of this invention are polymers containing long stretches of two or more monomeric units linked together by chemical valences in one single chain. During the biaxially orientation of the sheet, the block copolymers do not mix and create desired surface roughness and a lower surface gloss when compared to homopolymers. The preferred block copolymers of this invention are mixtures of polyethylene and polypropylene.

The final preferred method for increasing the surface roughness of smooth biaxially oriented sheets is embossing roughness into the sheet by use of a commercially available embossing equipment. Smooth films are transported through a nip that contains a nip roll and a impression roll. The impression roll under pressure and heat embosses the roll pattern onto the biaxially oriented smooth sheets. The surface roughness and pattern obtained during embossing is the result of the surface roughness and pattern on the embossing roll.

A random roughness pattern is preferred on the bottommost layer of the biaxially oriented sheet. A random pattern, or one that has no particular pattern is preferred to an ordered pattern because the random pattern best simulates the appearance and texture of cellulose paper which adds to the commercial value of a photographic image. A random pattern on the bottommost skin layer will reduce the impact of the surface roughness transferring to the image side when compared to an ordered pattern. A transferred surface roughness pattern that is random is more difficult to detect than a ordered pattern.

In order to successfully transport a photographic paper that contains a laminated biaxially oriented sheet with the desired surface roughness, on the opposite side of the image layer an antistatic coating on the bottommost layer is preferred. The antistat coating may contain any known materials known in the art which are coated on photographic web materials to reduce static during the transport of photographic paper. The preferred surface resistivity of the antistat coat at 50% RH is less than $10^{12}$ ohm/square.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312; and 5,055,371.

The preferred support is a photographic grade cellulose fiber paper. When using a cellulose fiber paper support, it is preferable to extrusion laminate the microvoided composite sheets to the base paper using a polyolefin resin Extrusion laminating is carried out by bringing together the biaxially oriented sheets of the invention and the base paper with application of an adhesive between them followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheet(s) in order to minimize curl in the resulting laminated support For high humidity applications (>50% RH) and low humidity applications (<20% RH), it is desirable to laminate both a front side and backside film to keep curl to a minimum.

In one preferred embodiment, in order to produce photographic elements with a desirable photographic look and feel, it is preferable to use relatively thick paper supports (e.g., at least 120 mm thick, preferably from 120 to 250 mm thick) and relatively thin microvoided composite sheets (e.g., less than 50 mm thick, preferably from 20 to 50 mm thick, more preferably from 30 to 50 mm thick).

As used herein the phrase "imaging element" is a material that may be used as a laminated support for the transfer of images to the support by techniques such as ink jet printing or thermal dye transfer, as well as a support for silver halide images. As used herein, the phrase "photographic elemen" is a material that utilizes photosensitive silver halide in the formation of images. In the case of thermal dye transfer or ink jet, the image layer that is coated on the imaging element may be any material that is known in the art such as such as gelatin, pigmented latex, polyvinyl alcohol, polycarbonate, polyvinyl pyrrolidone, starch, and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process,* Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The photographic elements of this invention may use emulsions doped with Group VIII metals such as iridium, rhodium, osmium, and iron as described in *Research Disclosure,* September 1996, Item 38957, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

In the following table, reference will be made to (1) *Research Disclosure,* December 1978, Item 17643, (2) *Research Disclosure,* December 1989, Item 308119, and (3) *Research Disclosure,* September 1996, Item 38957, all published by Kenneth Mason Publications, Ltd., Dudley Annex, 12a North Street, Emsworth, Hampshire PO10 7DQ, ENGLAND. The table and the references cited in the table are to be read as describing particular components suitable for use in the elements of the invention. The table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, | morphology and preparation. |
| | XI, XII, | Emulsion preparation |
| | XIV, XV | including hardeners, coating |
| | I, II, III, IX | aids, addenda, etc. |
| 3 | A & B | |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, | materials; Antistatic layers; |
| | XVI | matting agents |
| 3 | VIII, IX C | |
| | & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, | Developing agents |
| | XXII | |
| 3 | XVIII, XIX, | |
| | XX | |
| 3 | XIV | Scanning and digital processing procedures |

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The laminated substrate of the invention may have copy restriction features incorporated such as disclosed in U.S. patent application Ser. No. 08/598,785 filed Feb. 8, 1996 and application Ser. No. 08/598,778 filed on the same day. These applications disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the backside to enable users or machines to read and identify the media. The media may take the form of sheets that are capable of bearing an image. Typical of such materials are photographic paper and film materials composed of polyethylene resin coated paper, polyester, (poly)ethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light-sensitive media.

In a preferred embodiment the creation of the microdot pattern as a latent image is possible through appropriate temporal, spatial and spectral exposure of the photosensitive materials to visible or non-visible wavelengths of electromagnetic radiation. The latent image microdot pattern can be rendered detectable by employing standard photographic chemical processing. The microdots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in *Research Disclosure* 37038 of February 1995.

Commercial Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

The following examples illustrate the practice of this invention. They are not intended to be exhaustive of all possible variations of the invention. Parts and percentages are by weight unless otherwise indicated.

EXAMPLES

Example 1

The following laminated photographic bases in Table I were prepared by extrusion laminating one biaxially oriented sheet to the emulsion side of the photographic grade cellulose paper base and various biaxially oriented sheets to the backside of the photographic grade cellulose paper base.

The following sheet was laminated to the emulsion side of a photographic grade cellulose paper base:

Top sheet: (Emulsion side)

OPPalyte 350 ASW (Mobil Chemical Co.), a composite sheet (31 mm thick) (d=0.68 g/cc) consisting of a microvoided and oriented polypropylene core (approximately 60% of the total sheet thickness), with a homopolymer non-microvoided oriented polypropylene layer on each side; the void initiating material used is poly(butylene terephthalate).

The following sheets were then laminated to the backside of the photographic grade cellulose paper base creating photographic bases A–G: The skin layer in each laminate A–F was left exposed on the backside of the laminated base material.

Photographic paper base A

BICOR 70 MLT (Mobil Chemical Co.), a one-side matte finish, one-side treated biaxially oriented polypropylene sheet (18 mm thick) (d=0.9 g/cc) consisting of a solid oriented polypropylene core and a skin layer of a block copolymer of polyethylene and polypropylene.

Photographic paper base B

A one-side matte finish, one-side treated biaxially oriented polypropylene sheet (18 mm thick) (d=0.9 g/cc) consisting of a solid oriented polypropylene core and a skin layer of polypropylene and 25% $CaCO_3$.

Photographic paper base C

A one-side matte finish, one-side treated biaxially oriented polypropylene sheet (18 mm thick) (d=0.9 g/cc) consisting of a solid oriented polypropylene core and a skin layer of polypropylene and 15% $CaCO_3$.

Photographic paper base D

A one-side matte finish, one-side treated biaxially oriented polypropylene sheet (18 mm thick) (d=0.9 g/cc) consisting of a solid oriented polypropylene core and a skin layer of HDPE and 24% $CaCO_3$.

Photographic paper base E

A one-side matte finish, one-side treated biaxially oriented polypropylene sheet (18 mm thick) (d=0.9 g/cc) consisting of a solid oriented polypropylene core and a skin layer of HDPE and 16% $CaCO_3$.

Photographic paper base F

A one-side matte finish, one-side treated biaxially oriented polypropylene sheet (18 mm thick) (d=0.9 g/cc) consisting of a solid oriented LDPE core and a skin layer of LDPE and 10% silica.

Photographic paper base G

BICOR LBW (Mobil Chemical Co.), a biaxially oriented, two side treated polypropylene sheet (18 mm thick) (d=0.9 g/cc) consisting of a single solid polypropylene core and high energy treatment on one side. The high energy treated surface was exposed on the backside after lamination.

The photographic bases in Table I were prepared by melt extrusion laminating using 1924P Low Density Polyethylene (Eastman Chemical Co.) (a extrusion grade low density polyethylene with a density of 0.923 g/cm$^3$ and a melt index of 4.2) as the bonding layer. Both the top sheet and bottom sheets were laminated to a photographic grade cellulose paper. Photographic bases A–G were emulsion coated using Coating Format I detailed below:

| | Coating Format I | Laydown mg/m$^2$ |
|---|---|---|
| Layer 1 | Blue Sensitive Layer | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive Layer | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |

-continued

| | Coating Format I | Laydown mg/m$^2$ |
|---|---|---|
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Gelatin | 440 |
| | UV-1 | 20 |
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |
| | SiO$^2$ | 200 |
| | Surfactant | 2 |

APPENDIX

Y-1

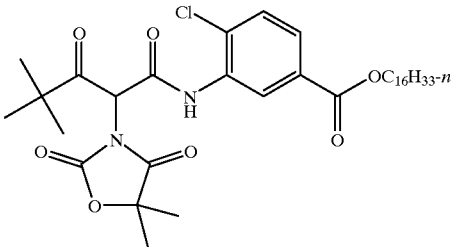

ST-1 = N-tert-butylacrylamide/n-butyl acrylate copolymer (50:50)

S-1 = dibutyl phthalate

SC-1

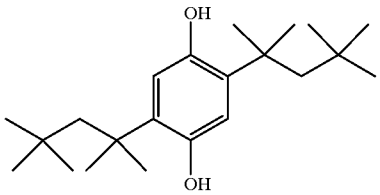

M-1

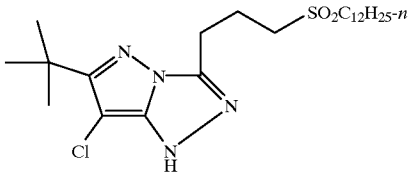

S-2 = diundecyl phthalate

ST-2

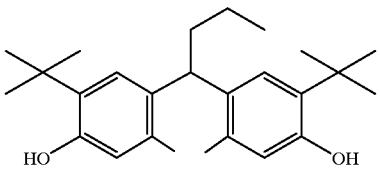

-continued

ST-3

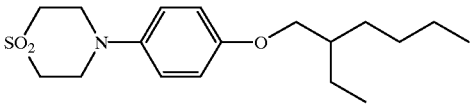

ST-4

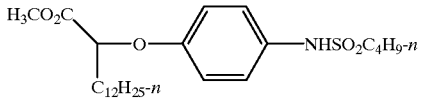

UV-1

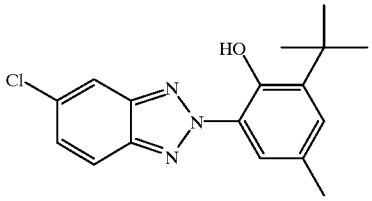

UV-2

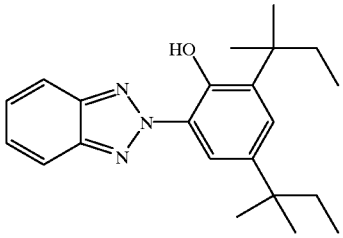

S-3 = 1,4-Cyclohexyldimethylene bis(2-ethylhexanoate)

C-1

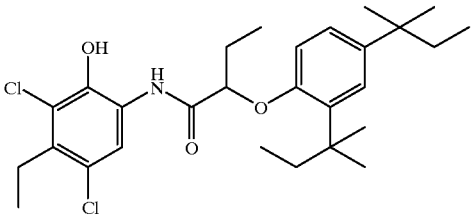

S-4 = 2-(2-Butoxyethoxy)ethyl acetate

S-4=2-(2-Butoxyethoxy)ethyl acetate

Dye 1

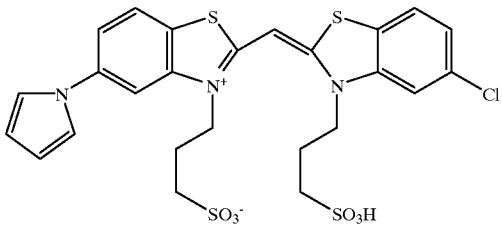

The roughness of the backside of each support variation was measured by TAYLOR-HOBSON Surtronic 3 with 2 $\mu$m diameter ball tip. The output Ra or "roughness average" from the TAYLOR-HOBSON is in units of micrometers and has a built in cut off filter to reject all sizes above 0.25 mm. The roughness averages of 10 data points for each base variation is listed in Table I.

Table I

| Base Variation | Roughness (micrometers) |
|---|---|
| A | 0.48 |
| B | 0.59 |
| C | 0.48 |
| D | 0.61 |
| E | 0.56 |
| F | 0.51 |
| G | 0.17 |

The data in Table I show the significant improvement in backside roughness of bases A–F compared to the roughness of a typical biaxially oriented polyolefin sheet (variation G). The improvement in backside roughness for bases A–F, when compared to variation G, is significant because variation A–F have been modified to provide sufficient backside roughness that will allowed for efficient transport thought the many types of photofinishing equipment that are commonly used to print, develop, and finish photographic images. The roughness improvement to the backside was also large enough to allow for efficient transport through digital printing hardware such as a ink jet printers or a thermal dye transfer printers. Furthermore, variations A–F have similar backside roughness when compared to photographic paper manufactured with polyethylene cast against a rough chilled roll.

Bases A–F showed an improvement in the ability to write on the backside with a pen or pencil compared to standard photographic paper. Photographic images made from bases A–F were also improved for photographic print blocking as compared to images made with base G.

The invention has been described in detail with particular reference to certain preferred embodiments thereof, but it will be understood that variations and modifications can be effected within the spirit and scope of the invention.

What is claimed is:

1. An imaging element comprising a biaxially oriented polymer sheet comprising at least two layers adhered to the bottom surface of a base paper, an image layer adhered to the top side of said base paper, wherein said biaxially oriented sheet adhered to the bottom surface has on the exposed surface a surface roughness average of between about 0.30 to 2.00 μm, and wherein a bottom surface layer on the bottom surface of the biaxially oriented polymer sheet comprises incompatible block copolymers of polypropylene and polylethylene.

2. The element of claim 1 wherein said element comprises at least one photosensitive silver halide containing layer on the top surface of a top biaxially oriented sheet.

3. The element of claim 1 wherein said surface roughness is in a random pattern.

4. The element of claim 1 further comprising an antistatic coating.

5. The element of claim 1 further comprising an antistatic coating.

6. The element of claim 1 wherein the bottom surface layer of said biaxially oriented sheet further comprises inorganic particulate materials selected from the group consisting of titanium dioxide, silica, calcium carbonate, barium sulfate and kaolin and mixtures thereof.

7. The element of claim 1 wherein the bottom surface layer further comprises inorganic particulate materials having a size between 0.20 μm and 10 μm.

8. The element of claim 2 wherein said surface roughness has a surface roughness average of between about 0.30 to 1.00 μm.

9. The element of claim 2 wherein said biaxially oriented polyolefin polymer sheet is located between said at least one photosensitive layer and said base paper and the bottom sheet is polyolefin polymer.

10. A method of forming an imaging element comprising providing a paper base material and laminating a biaxially oriented polymer sheet comprising at least two layers to said base paper material wherein the exposed surface of the sheet has a surface roughness average between about 0.30 μm and 2.00 μm, wherein a bottom exposed surface layer on the bottom surface of the biaxially oriented polymer sheet comprises incompatible block copolymers of polypropylene and polylethylene.

11. The method of claim 10 wherein said exposed surface comprises particles in the surface layer of the biaxially oriented film.

12. The method of claim 10 wherein said surface roughness has a surface roughness average of between about 0.30 to 1.00 μm.

13. The method of claim 10 wherein a surface layer of said biaxially oriented sheet sheet opposite to the side adjacent said paper base further comprises inorganic particulate materials selected from the group consisting of titanium dioxide, silica, calcium carbonate, barium sulfate and kaolin and mixtures thereof.

14. The method of claim 13 wherein said surface layer further comprises inorganic particulate materials having a size between 0.20 μm and 10 μm.

15. The method of claim 12 wherein said element comprises at least one photosensitive silver halide containing layer on the top surface of a top biaxially oriented sheet.

16. The method of claim 15 wherein there is a biaxially oriented sheet located between said at least one photosensitive layer and said base paper.

17. A photographic imaging element comprising a layer of biaxially oriented polymer sheet comprising at least two layers adhered to the bottom surface of a base paper, a top layer of biaxially oriented polymer sheet adhered to the top of said element, at least one silver halide layer on the upper side of said top sheet, wherein said biaxially oriented sheet adhered to the bottom surface has on the exposed surface a surface roughness average of between about 0.30 to 2.00 μm and wherein a layer on the bottom surface of the biaxially oriented sheet comprises incompatible block copolymers of polypropylene and polyethylene.

18. The element of claim 17 wherein said surface roughness has a surface roughness average of between about 0.30 to 1.00 μm.

19. A imaging element comprising a layer of biaxially oriented polymer sheet comprising at least two layers adhered to the bottom surface of a base paper and a biaxially oriented polymer sheet adhered to the top surface of said base paper, and an image layer on top of the top polymer sheet wherein said biaxially oriented sheet adhered to the bottom surface has on the exposed surface a surface roughness average of between about 0.30 to 2.00 μm and wherein the layer on the bottom surface of a biaxially oriented sheet comprises incompatible block copolymers of polypropylene and polyethylene.

20. The element of claim 19 wherein said surface roughness has a surface roughness average of between about 0.30 to 1.00 μm.

21. The element of claim 19 further comprising an antistatic coating.

* * * * *